US006578983B2

(12) United States Patent
Holten

(10) Patent No.: US 6,578,983 B2
(45) Date of Patent: Jun. 17, 2003

(54) TUBULAR LAMP LUMINAIRE WITH CONVEX AND CONCAVE REFLECTOR SIDES

(75) Inventor: Petrus Adrianus Josephus Holten, Winterswijk (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 10/081,962

(22) Filed: Feb. 21, 2002

(65) Prior Publication Data

US 2002/0141182 A1 Oct. 3, 2002

(30) Foreign Application Priority Data

Feb. 23, 2001 (EP) ..... 01200664

(51) Int. Cl.[7] ..... F21S 4/00
(52) U.S. Cl. ..... 362/217; 362/296; 362/225
(58) Field of Search ..... 362/217, 241, 362/260, 225, 296

(56) References Cited

U.S. PATENT DOCUMENTS 4,403,275 A 9/1983 Oser ..... 362/220
4,719,546 A * 1/1988 Spitz ..... 362/260
4,888,668 A * 12/1989 Roll ..... 362/291
5,988,836 A * 11/1999 Swarens ..... 362/364
6,250,772 B1 * 6/2001 Entrop et al. ..... 362/225

FOREIGN PATENT DOCUMENTS

AT B386671 9/1988
AT 386671 B 9/1988 ..... F21V/7/09

* cited by examiner

*Primary Examiner*—Stephen Husar
*Assistant Examiner*—Ronald E. DelGizzi

(57) ABSTRACT

The luminaire for a tubular lamp having a reflector (1) with side portions (10), which have a first convex area (11) with an outer edge (12) in the light emission window (3), and a concave area (13) having an inner edge (15), which joins the convex area (11) in a line of points of inflection (14). Means (20) for accommodating a lamp (L) define the axis (21) of the lamp. The line of inflection points (14) is located at a distance from the light emission window (3), which is 0.30 to 0.40 of the distance from the outer edge (12) to the axis (21). The luminaire produces a light beam allowing a large spacing between equal luminaires while maintaining a uniform illumination.

Twin versions of the luminaire allow a ballast (22) to be accommodated between adjacent side portions (10), thereby enabling the use of a slim housing (30).

7 Claims, 2 Drawing Sheets

TUBULAR LAMP LUMINAIRE WITH CONVEX AND CONCAVE REFLECTOR SIDES

The invention relates to a luminaire comprising:

a hollow reflector having a plane of symmetry, a light emission window extending transversely to the plane of symmetry, reflector side portions on either side of the plane of symmetry; and means, in the plane of symmetry, for accommodating a tubular electric lamp along the light emission window, which means define a position of an axis of the lamp to be accommodated, in the plane of symmetry, which reflector side portions each include a first, convex area with an outer edge in the light emission window, and a second concave area which connects to the first, convex area in a line of inflection points, and which has an inner edge close to the axis of the lamp to be accommodated, the line of inflection points being situated at a distance from the light emission window, and the reflector side portions form a lateral screening angle $\alpha$ of at least 25°.

Such a luminaire is disclosed in AT-B-386 671.

The known luminaire is intended for use in rooms where display screens are employed.

Therefore, such luminaires are designed such that they do not, or hardly, emit light sideways at an angle of, for example, at least 25° with the light emission window, i.e. the so-termed screening angle, in order to make sure that annoying reflections on display screens are avoided. To achieve this, the lamp is arranged so high in the reflector that said lamp is invisible from the screening angle and hence does not emit light in said screening angle. Customarily, such luminaires comprise a concave, for example parabolically curved reflector, which is formed such that also light reflected by the reflector, which light intersects the plane of symmetry of the reflector, is not emitted within the screening angle.

It has been found that small errors in the manufacture of the reflector can lead to deviant shapes, as a result of which parts of the reflector situated near the light emission window do emit light within said screening angle.

In order to increase the permissible variation in shape, and hence preclude this undesirable reflection within the screening angle, the known luminaire in accordance with said AT-B-386 671 comprises a reflector with reflector side portions having a first convex area near the light emission window. The parts of the reflector that are situated near the light emission window thus do not reflect light which, upon reflection, intersects the plane of symmetry at a comparatively small angle with the light emission window; instead they only reflect light which, upon reflection at the outer edge, is emitted at comparatively large angles perpendicularly to the light emission window. The transition from the convex area to the concave area of the reflector side portions, i.e. the line of inflection points, is situated, in the case of the known luminaire, at approximately half the distance from the inner edge to the light emission window. The light that is reflected near the inner edge is emitted perpendicularly to the light emission window.

A drawback of the known luminaire resides in that it produces a comparatively narrow-angle beam, i.e. a beam with a comparatively high luminous flux on the axis and a comparatively rapid reduction of the luminous flux at comparatively small angles with the axis, and in that, if a plurality of luminaires are necessary to illuminate a comparatively large room, the luminaires must be comparatively closely spaced in order to obtain a uniform illumination. As a result, the installation and maintenance costs of the lighting are high.

U.S. Pat. No. 4,403,275 discloses a luminaire comprising a box-shaped housing without a reflector, which luminaire is designed so as to accommodate four juxtaposed, tubular lamps. A smaller luminous flux is obtained by omitting the outermost lamps from said luminaire. Light generated by the innermost lamps may be lost in corners of the housing. This loss is limited by incorporating a screen that is S-shaped in cross-section in the lamp holders intended for the outermost lamps. This luminaire emits light at a very small angle with the light emission window and hence cannot suitably be used in rooms where display screens are employed.

It is an object of the invention to provide a luminaire of the type described in the opening paragraph, which, while the emission of light in the screening angle is precluded, emits light in a uniform manner, also if use is made of a plurality of similar luminaires arranged at comparatively large distances from each other.

In accordance with the invention, this object is achieved in that the distance from the line of inflection points to the light emission window is 0.30 to 0.40 of the distance from the outer edge to the axis of the lamp to be accommodated.

As the line of inflection points is situated comparatively close to the light emission window, the light emission of the luminaire in accordance with the invention, after reflection of the light by a zone situated around the line of inflection points, is such that comparatively much light is sent far away, through the plane of symmetry, at a comparatively small angle with the light emission window. The line of inflection points of the reflector known from said AT-B-386 671 is situated much higher, namely at 0.50 of the distance between the outer edge and the axis of the lamp, which corresponds to 0.54 of the distance from the inner edge to the light emission window.

As a result of the wider spread of the light, which will be shown in the drawings, luminaires in accordance with the invention can be arranged comparatively far apart to obtain a uniform illumination.

The luminaire in accordance with the invention has the advantage that it has a comparatively high flexibility, enabling identical reflector side portions of the reflector to be positioned such that the outer edges are situated at varying distances from each other. As a result, said distance can be adapted to the measurements of modular ceiling systems if the luminaire must be incorporated therein. For example, said distance can be varied between, for example, 125 and 140 mm. By changing the distance between the outer edges, the distance from the outer edge to the axis of the lamp to be accommodated changes too, which axis is defined by the means for accommodating a lamp. Thus, while using an identical reflector side portion, also the position of the line of inflection points changes with respect to the light emission window, expressed as a fraction of the distance from the outer edge to the lamp axis.

Advantageously, the second area is formed, near its inner edge, so as to send the light reflected by it substantially through the plane of symmetry. The light reflected at said location enlarges the luminous flux in directions enclosing an angle with the plane of symmetry, which is not the case in the known luminaire, where light reflected at this location issues to the exterior perpendicularly through the light emission window to contribute to the center of the beam. A uniform illumination is thus obtained at even larger intervals between the luminaires. It is favorable for the second area to be shaped, near its inner edge, such that reflection at the lamp to be accommodated is at least substantially avoided. By virtue thereof, the disturbance of the beam path and loss of light by light absorption by the lamp are precluded.

For the same reason, it is advantageous if the first area is formed such that light reflected by it near the outer edge can be reflected, on the same side of the plane of symmetry, in directions aside. In the known luminaire, at this location the light is emitted to the exterior at right angles to the light emission window so as to contribute to the center of the beam.

In a favorable modification of the luminaire comprising a concave area that extends as far as the inner edge, the second area has a flat zone along the inner edge. By the flat, essentially noncurved zone, comparatively much light is sent obliquely through the plane of symmetry and the light emission window to the exterior, so that, at a uniform or substantially uniform light distribution in the beam, it is possible to employ reflector side portions having a smaller surface area of the second portion. As a result, a saving in material costs can be realized. A further advantage resides in that the reflector side portions can be readily manufactured by roll forming.

The luminaire may comprise a second, substantially identical reflector with second means for accommodating a second lamp, with means for operating the lamps to be accommodated being present between the reflector and the second reflector. A particularly favorable property of the luminaire in accordance with the invention is that, as a result of the shape of the reflector side portions, which shape is also determined by the location of the line of inflection points, there is enough space between the two juxtaposed reflector side portions of a twin or multiple luminaire to accommodate, for example, a ballast or an electronic starter for discharge lamps to be accommodated. As a result, the depth of the luminaire can be reduced, so that less material is necessary and, if the luminaire is to be mounted in a floating ceiling, a smaller space between said floating ceiling and the actual ceiling is sufficient.

The luminaire can be suspended from a ceiling. Said luminaire may be open on the upper side so as to also emit indirect light, or it may be closed. On the other hand, the luminaire may be mounted to or in a ceiling. If desired, the light emission window may be provided with lamellae extending transversely to the plane of symmetry, which lamellae serve to also create a screening angle in the longitudinal direction of the luminaire. The lamellae may be flat or three-dimensional, for example with hollow, such as parabolically curved, side faces. The side faces of flat lamellae may be provided with a relief pattern of, for example, sawtooth-shaped strips, to reflect incident light in a downward direction.

The reflector and, if present, the lamellae may be of a synthetic resin or of a metal, such as aluminum. They may be polish finished, semipolish finished or matt finished. They may alternatively be made of a lacquered material.

The lamellae may have parallel edges in the light emission window and, for example, straight edges within the reflector or, in a suitable case, they may have a concave edge in the light emission window and a convex edge within the reflector. Alternatively, both edges may be convex.

It is favorable for the reflector to be accommodated in a housing which is, for example, diffusely reflecting. In this case, an opening between the inner edges of the reflector is covered, opposite the light emission window, by the housing. And radiation which is diffusely reflected by the housing is uniformly added to the light beam.

The luminaire in accordance with the invention can particularly suitably be used to accommodate a fluorescent lamp having a diameter of, for example, approximately 26 or approximately 16 mm.

Embodiments of the luminaire in accordance with the invention are shown in the drawing.

Figure 1:
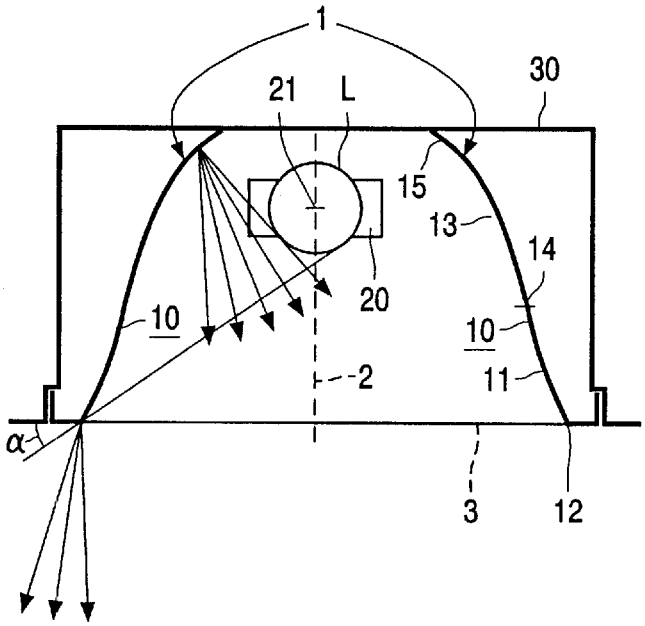
FIG. 1 is a cross-sectional view of a first embodiment.

The luminaire shown in FIG. 1 has a hollow reflector 1 with a plane of symmetry 2. A light emission window 3 extends transversely to the plane of symmetry 2. The reflector 1 comprises reflector side portions 10 on either side of the plane of symmetry 2. The luminaire comprises means 20 in the plane of symmetry 2 enabling a tubular electric lamp L to be accommodated along the light emission window 3. Said means define a position of an axis 21 of the lamp L to be accommodated in the plane of symmetry 2. The means shown in the Figure are a pair of lamp holders, one of which is visible and the other extends in line therewith in front of the plane of the drawing, said pair of lamp holders being suitable to accommodate a linear fluorescent lamp.

The reflector side portions 10 each comprise a first area 11, which has an outer edge 12 in the light emission window 3 and extends, as a convex area, away from the light emission window, and a second, concave area 13 which joins the first, convex area 11 in a straight line of inflection points 14. The second area has an inner edge 15 near the axis 21 of the lamp L to be accommodated. The line of inflection points 14 is situated at a distance from the light emission window 3. The reflector side portions 10 yield a lateral screening angle $\alpha$ of at least 25°, and 30° in the Figure shown.

The distance from the line of inflection points 14 to the light emission window 3 is 0.30 to 0.40 of the distance from the outer edges 12 to the axis 21 of the lamp L to be accommodated.

Near its inner edge 15, the second area 13 is formed so as to send the light reflected by said area substantially through the plane of symmetry 2. In the Figure, the rays reflected at the edge itself are shown, which rays originate from the upper side of the lamp L, the lower side, the center and from two intermediate locations. This shows that one ray, originating from the upper side of the lamp L, is reflected substantially parallel to the plane of symmetry 2, while the other rays intersect the plane of symmetry 2.

Even in the case of reflection at the inner wall 15 itself, reflection to the lamp L is precluded at least substantially.

The first area 11 is formed such that light reflected by it near the outer edge 12 is reflected, on the same side of the plane of symmetry 2, in directions aside. In the Figure, two outermost rays originating, as a result of reflection at the outer edge 12, from rays originating from the upper side and the lower side of the lamp L, as well as a ray which, as a result of reflection, originates from a ray originating from the center of the lamp L. The Figure shows that one ray, originating from the lower side of the lamp L, is reflected in a direction substantially parallel to the plane of symmetry, while the other rays are caused to diverge in directions aside the luminaire.

The reflector is accommodated in a housing 30 which is diffusely reflecting.

The line of inflection points 14 is at a distance of approximately 31 mm from the light emission window 3. As regards the luminaire in accordance with the invention shown in FIG. 1, where the outer edges 12 are at a distance of 125 mm from each other, the axis 21 of the lamp L is situated at a distance of 84 mm from the outer edges 12, and hence the distance of the line of inflection points 14 is 0.37 of the distance from the axis to the outer edge. At a distance between the outer edges 12 of 140 mm, the distance from the axis 21 to the outer edges 12 is 90 mm. As a result, the distance of the line of inflection points 14 is 0.34 of the distance from the axis to the outer edge.

Figure 2:
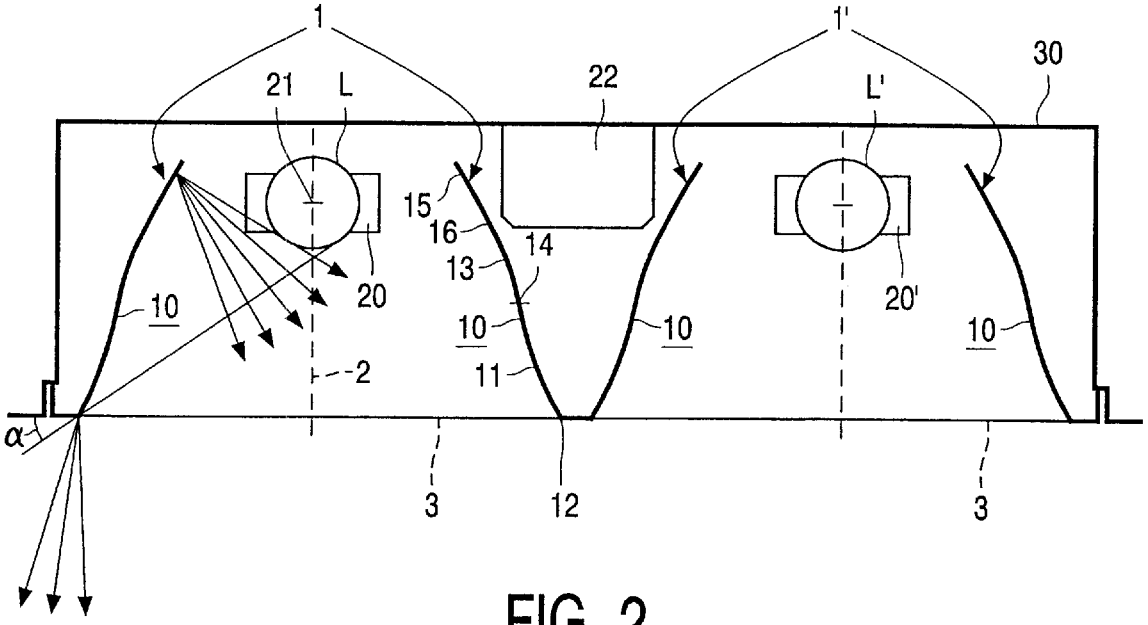
FIG. 2 is a cross-sectional view of a second embodiment.

In FIG. 2, corresponding parts are indicated by means of the same reference numeral as in FIG. 1. In FIG. 2, the second area 13 has a flat zone 16 along the inner edge 15. This zone 16 can be used very effectively to laterally reflect light through the plane of symmetry 2. By virtue thereof, a smaller dimension of the reflector side portions 10 in FIG. 2 is sufficient to create a beam distribution which is substantially identical to that shown in FIG. 1.

The luminaire shown in FIG. 2 is a twin luminaire comprising a second, substantially identical reflector 1' and second means 20' for accommodating a second lamp L', with means 22 for operating the lamps L, L' to be accommodated being present between the reflector 1 and the second reflector 1'. Said means 22 comprise, in the embodiment shown, two ballasts or, in a variant, a twin ballast.

A comparison between FIG. 1 and FIG. 2 shows that the specific convex/concave shape of the reflector side portions 10 of the luminaire in accordance with the invention enables, in a multiple luminaire, to accommodate means 22 in the housing 30 between two neighboring reflector side portions 10, while said means 22 could not be accommodated in an equally high housing 30, as shown in FIG. 1, for lack of space.

In FIG. 2, the line of inflection points 14 is situated at a distance of approximately 30 mm from the light emission window 3. In the case of the luminaire according to the invention, as shown in FIG. 2, where the outer edges 12 are situated at a distance of 125 mm from each other, the axis 21 of the lamp L is situated at a distance of 84 mm from the outer edges 12 and, consequently, the distance of the line of inflection points 14 is 0.36 of the distance from the axis to the outer edges. If the distance between the outer edges 12 is 140 mm, then the distance from the axis 21 to the outer edges 12 is 90 mm. Thus, the distance of the line of inflection points 14 is 0.33 of the distance from the axis to the outer edge.

Figure 3:
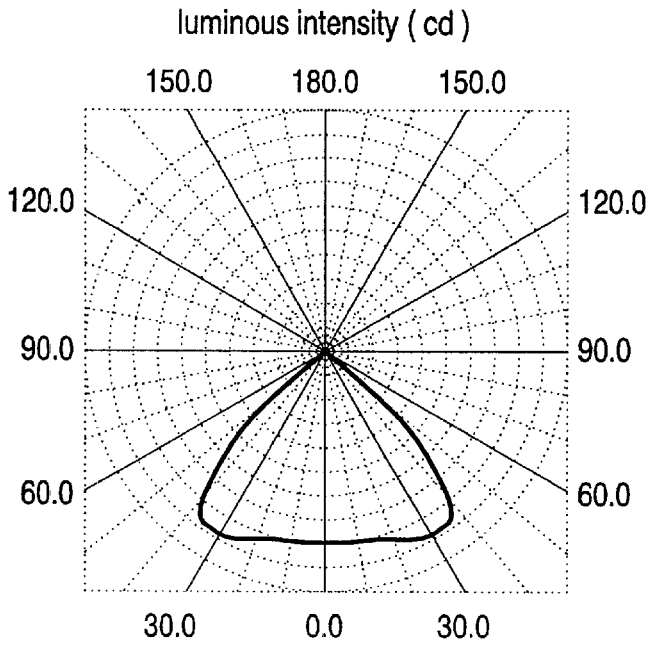
FIG. 3 shows the light intensity distribution diagram obtained by means of the luminaire shown in FIG. 1.

The diagram shown in FIG. 3 shows the light intensity distribution in a plane at right angles to the plane of symmetry 2. The line 0.0–180.0 coincides with the plane of symmetry 2, the line 90.0–90.0– is situated in the light emission window. As is customary, the light intensity distribution is converted to that obtained at a luminous flux of 1000 lm. As a result, the light intensity distributions of different luminaires comprising different lamps can be directly compared with each other.

Figure 4:
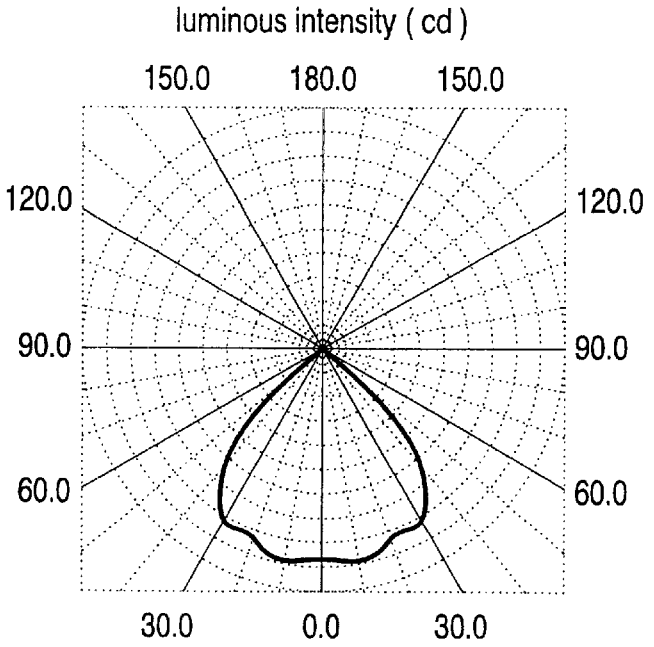
FIG. 4 shows the light intensity distribution diagram obtained by means of the known luminaire.

The light intensity distributions shown in FIGS. 3 and 4 relate to, respectively, the luminaire in accordance with the invention and the known luminaire provided with an aluminum high-gloss reflector having a reflection coefficient of 0.85 in a lacquered housing with a reflection coefficient of 0.88.

A comparison of the light intensity distribution of FIG. 3 with the light intensity distribution of FIG. 4, which belongs to the known luminaire mentioned in the opening paragraph, reveals that both luminaires do not, or hardly, emit light between 60° and 90° in both directions and hence have a screening angle $\alpha$ of 30°. It has further been found that the light intensity distribution shown in FIG. 4 has maximum values at 10°, whereas FIG. 3 has maximum values in the range from approximately 30° to approximately 35°. It is favorable that the luminous intensity at angles in the range from 30° to 35° is higher than at an angle of 0°, because, if a surface extending parallel to the light emission window is illuminated, then, at larger angles, said surface is at a larger distance than at smaller angles and hence the beam must emit more light in said direction to obtain an equal illumination intensity. FIG. 3 shows that, at angles above 35°, still a considerable luminous flux is emitted as compared to the maximum values, whereas, in FIG. 3, the luminous flux at said angles is negligible as compared to the maximum values. The light intensity distribution shown in FIG. 3 is delta-shaped, while the light intensity distribution shown in FIG. 4 is drop-shaped. In comparison with the known luminaire, the luminaire in accordance with the invention has a more uniform light distribution over a larger field and enables luminaires to be arranged at a larger distance from each other to uniformly illuminate a very large field.

The light intensity distribution of the luminaire shown in FIG. 2 is substantially equal to that shown in FIG. 3.

If a plurality of luminaires in accordance with the invention are suspended in a square grid, the grid size may be maximally 1.7 times the height of suspension to make sure that uniform illumination is maintained. As regards the known luminaire, the grid size may maximally amount to 1.4 times the height of suspension.

Also combinations of features of the luminaire in accordance with the invention other than those indicated in the claims are possible.

What is claimed is:

1. A luminaire comprising:

a hollow reflector (1) having a plane of symmetry (2), a light emission window (3) extending transversely to the plane of symmetry (2), reflector side portions (10) on either side of the plane of symmetry (2); and means (20), in the plane of symmetry (2), for accommodating a tubular electric lamp (L) along the light emission window (3), which means define a position of an axis (21) of the lamp (L) to be accommodated in the plane of symmetry (2), which reflector side portions (10) each include a first, convex area (11) with an outer edge (12) in the light emission window (3), and a second concave area (13) which connects to the first, convex area (11) in a line of inflection points (14), and which has an inner edge (15) close to the axis (21) of the lamp (L) to be accommodated, the line of inflection points (14) being situated at a distance from the light emission window (3), and the reflector side portions (10) forming a lateral screening angle $\alpha$ of at least 25°, characterized in that the distance from the line of inflection points (14) to the light emission window (3) is 0.30 to 0.40 of the distance from the outer edge (12) to the axis (21) of the lamp (L) to be accommodated.

2. A luminaire as claimed in claim 1, characterized in that the second area (13) is formed, near its inner edge (15), so as to send the light reflected by it substantially through the plane of symmetry (2).

3. A luminaire as claimed in claim 1, characterized in that the second area (13) is formed, near its inner edge (15), so as to send light reflected by it through the plane of symmetry (2) and, thus, at least substantially avoid reflection at the lamp (L) to be accommodated.

4. A luminaire as claimed in claim 2, characterized in that the first area (11) is formed such that light reflected by it near the outer edge (12) can be reflected, on the same side of the plane of symmetry (2), in directions aside.

5. A luminaire as claimed in claim 2, characterized in that the second area (13) comprises a flat zone (16) along the inner edge (15).

6. A luminaire as claimed in claim 1, characterized in that a second, substantially identical reflector (1') and second means (20') for accommodating a second lamp (L') are present, with means (22) being present between the reflector (1) and the second reflector (1') for operating the lamps (L, L') to be accommodated.

7. A luminaire as claimed in claim 1, characterized in that the reflector is accommodated in a housing (30) which is diffusely reflecting.

* * * * *